US011404198B2

(12) United States Patent
Inaba et al.

(10) Patent No.: US 11,404,198 B2
(45) Date of Patent: Aug. 2, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kazuhiro Inaba, Mie (JP); Kouji Nishi, Mie (JP); Kouhei Yoshikawa, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 546 days.

(21) Appl. No.: 16/485,983

(22) PCT Filed: Jan. 29, 2018

(86) PCT No.: PCT/JP2018/002645

§ 371 (c)(1),
(2) Date: Aug. 14, 2019

(87) PCT Pub. No.: WO2018/150852

PCT Pub. Date: Aug. 23, 2018

(65) Prior Publication Data

US 2020/0143974 A1 May 7, 2020

(30) Foreign Application Priority Data

Feb. 15, 2017 (JP) ..... JP2017-026482

(51) Int. Cl.
*H01F 17/04* (2006.01)
*H01F 27/26* (2006.01)
(Continued)

(52) U.S. Cl.
CPC ..... *H01F 27/263* (2013.01); *H01F 27/2823* (2013.01); *H01F 41/0246* (2013.01)

(58) Field of Classification Search
CPC ..... H01F 27/2823
(Continued)

(56) References Cited

U.S. PATENT DOCUMENTS 8,581,685 B2 * 11/2013 Ono ..... H01F 41/127 336/212
8,598,973 B2 * 12/2013 Kawaguchi ..... H01F 27/263 336/212
(Continued)

FOREIGN PATENT DOCUMENTS

JP 2016-054287 A 4/2016
JP 2016-171137 A 9/2016

OTHER PUBLICATIONS

International Search Report, Application No. PCT/JP2018/002645, dated Mar. 20, 2018. ISA/Japan Patent Office.

*Primary Examiner* — Ronald Hinson
(74) *Attorney, Agent, or Firm* — Honigman LLP

(57) ABSTRACT

Provided is a reactor including a coil provided with two winding portions that are obtained by winding a winding wire such that axes of the winding portions are parallel to each other, and a magnetic core including a rectangular parallelepiped inner core portion disposed in each of the winding portions, and outer core portions that are disposed outside the winding portions and are for linking the inner core portions, in which at least one of two outer corner portions out of four corner portions of each of the inner core portions includes a corner chamfering portion that has been chamfered more than an inner corner portion that is opposite the outer corner portion, the four corner portions facing an inner circumferential surface of the winding portion and the two outer corner portions being disposed on the side of each winding portion that is distant from the other winding portion.

6 Claims, 5 Drawing Sheets

(51) Int. Cl.
*H01F 27/28* (2006.01)
*H01F 41/02* (2006.01)

(58) Field of Classification Search
USPC ..... 336/212, 221
See application file for complete search history.

(56) References Cited

U.S. PATENT DOCUMENTS

| | | | | |
|---|---|---|---|---|
| 9,099,236 | B2 * | 8/2015 | Nomura | H01F 37/00 |
| 2013/0181801 | A1 * | 7/2013 | Yoshikawa | H01F 27/263 336/180 |
| 2013/0182478 | A1 * | 7/2013 | Nomura | H02M 3/155 336/61 |
| 2014/0015368 | A1 * | 1/2014 | Okumura | H02K 15/045 310/208 |
| 2014/0159844 | A1 * | 6/2014 | Suzuki | H01F 27/24 336/65 |
| 2014/0293655 | A1 * | 10/2014 | Inaba | H01F 3/08 336/90 |
| 2015/0043262 | A1 * | 2/2015 | Ito | H02M 7/537 336/178 |
| 2015/0130576 | A1 * | 5/2015 | Suzuki | H01F 27/022 29/605 |
| 2016/0189862 | A1 * | 6/2016 | Miyauchi | H01F 37/00 29/606 |
| 2018/0261370 | A1 * | 9/2018 | Hirabayashi | H01F 27/24 |
| 2019/0198219 | A1 * | 6/2019 | Shirai | H01F 27/245 |

* cited by examiner

REACTOR

CROSS-REFERENCE TO RELATED APPLICATIONS

This application is the U.S. national stage of PCT/JP2018/002645 filed on Jan. 29, 2018, which claims priority of Japanese Patent Application No. JP 2017-026482 filed on Feb. 15, 2017, the contents of which are incorporated herein.

TECHNICAL FIELD

The present disclosure relates to a reactor.

BACKGROUND

A reactor is one type of component of a circuit for increasing or reducing voltage. JP 2016-171137A discloses a reactor including a coil provided with a pair of winding portions obtained by helically winding a winding wire, an annular magnetic core disposed on the inner and outer sides of the winding portions, a tubular interposing member interposed between rectangular parallelepiped portions of the magnetic core disposed in the winding portions and the winding portions, and a resin molded portion for integrally holding the coil and the magnetic core. The winding portions have a rectangular tubular shape with round corner portions, and are arranged side by side such that their axes are parallel to each other. In the rectangular parallelepiped portions of the magnetic core disposed in the winding portions, all four corner portions facing the inner circumferential surfaces of the winding portions are evenly round along the inner circumferential surfaces of the winding portions.

There is a need for reactors with low loss that can have high inductance while being small.

There is still room for improvement in terms of inductance properties in a conventional configuration in which corner portions are evenly round in portions of the above-described magnetic core that are disposed in the winding portions.

In view of this, an object of this disclosure is to provide a reactor with low loss that can have high inductance while being small.

SUMMARY

A reactor according to this disclosure includes a coil provided with two winding portions that are obtained by winding a winding wire such that axes of the winding portions are parallel to each other, and a magnetic core including a rectangular parallelepiped inner core portion disposed in each of the winding portions, and outer core portions that are disposed outside the winding portions and are for linking the inner core portions, in which at least one of two outer corner portions out of four corner portions of each of the inner core portions includes a corner chamfering portion that has been chamfered more than an inner corner portion that is opposite the outer corner portion, the four corner portions facing an inner circumferential surface of the winding portion and the two outer corner portions being disposed on the side of each winding portion that is distant from the other winding portion.

An "inner corner portion" refers to a corner portion disposed on the side of each winding portion that is close to the other winding portion.

Inventors of the present disclosure found that, if a specific corner portion out of the corner portions of an inner core portion is largely chamfered, even if the magnetic path area is smaller than that of the above-described conventional configuration, an increase in loss is significantly small and inductance is high. The present disclosure is based on this finding.

According to the above-described reactor, although an outer corner portion of the inner core portion is largely chamfered, compared to an inner corner portion, a largely chamfered portion is limited to only an outer corner portion. Thus, a decrease in the magnetic path area of the inner core portion resulting from a corner chamfering portion being provided is small, and an increase in leakage flux resulting from a decrease in the magnetic path area is also small. Thus, an increase in copper loss resulting from leakage flux is also small. Also, because the inner core portion is small due to a corner chamfering portion being provided, iron loss can be also reduced. In such a reactor described above, an increase in the total loss of copper loss and iron loss is small, and thus the reactor has low loss. Also, as described above, although the above-described reactor has a small magnetic path area due to the corner chamfering portion being provided, the reactor exhibits a special effect of having high inductance compared to the above-described conventional configuration (see Test Example 1, which will be described later). In a case where inductance is kept constant, the size of a magnetic core can be easily reduced, and such a reactor described above can be reduced in size. Thus, the above-described reactor can have high inductance with low loss due to the above-described corner chamfering portion being provided, without increasing the size of the reactor.

Furthermore, the above-described reactor has good strength and the outer corner portions are unlikely to be chipped when a coil and a magnetic core are assembled, due to the corner chamfering portion being provided. If a resin molded portion and an inner interposing member, which will be described later, are included, the reactor has good strength because a region of the resin molded portion or the inner interposing member covering the corner chamfering portions can be made locally thick. The reactor has excellent strength from the viewpoint that, even if molding pressure is concentrated at an outer corner portion when the resin molded portion is formed, the corner portion is unlikely to be chipped due to the corner chamfering portions being provided.

An example of the above-described reactor is a mode in which the corner chamfering portion is C-chamfered.

In the above-described mode, high inductance can be realized while being able to reduce the size, loss is low, the outer corner portions of the inner core portion are unlikely to be chipped, and strength is improved. If a resin molded portion and an inner interposing member, which will be described later, are included, a region of the resin molded portion or the inner interposing member covering the corner chamfering portions can be made thicker, and strength can be more easily increased.

An example of the above-described reactor is a mode in which a resin molded portion for integrally holding the inner core portions and the outer core portions is included, and the resin molded portion includes an inner resin portion that fills a space between the winding portions and the inner core portions and covers at least a portion of an outer circumferential surface of the inner core portions.

In the above-described mode, high inductance can be realized while being able to reduce the size, loss is low, and strength is improved because, even if molding pressure is concentrated at the outer corner portion when a resin molded portion, in particular, an inner resin portion is formed, the outer corner portion is unlikely to be chipped due to the corner chamfering portions being provided. Also, in the above-described mode, strength is also improved because the magnetic core serving as an integrated object has high rigidity due to the inner core portions and the outer core portions being integrated using the resin molded portion. Also, portions, which are sandwiched between the corner portions of the winding portions and the corner chamfering portions, of square tubular spaces provided between the winding portions and the inner core portions are locally large. The inner resin portion can include a thick columnar portion resulting from this surrounding portion being filled by the inner resin portion. The inner core portion can be supported by the columnar portion, and thus the magnetic core serving as an integrated object has higher rigidity, and the magnetic core has improved strength.

An example of the reactor according to (3) above including the above-described inner resin portion is a mode in which the maximum thickness of an outer corner coating portion of the inner resin portion covering the corner chamfering portion is thicker than the maximum thickness of an inner corner coating portion of the inner resin portion covering the inner corner portion.

The outer corner coating portion in the above-described mode corresponds to the above-described thick columnar portion. In the above-described mode, the inner core portion can be supported by the columnar outer corner coating portion disposed at the outer corner portion of the inner core portion. Specifically, out of all four outer corner portions of the two inner core portions that are arranged side by side, two corner portions located at diagonal positions and two corner portions located at opposite positions are supported by the above-described columnar portions. In such a mode described above, strength is improved.

An example of the reactor according to the embodiments above including the above-described inner resin portion is a mode in which inner interposing members that are respectively interposed between the winding portions and the inner core portions and attached to the inner core portions are included, and the maximum thickness of an outer corner interposing portion of the inner interposing member covering the corner chamfering portion is thicker than the maximum thickness of an inner corner interposing portion of the inner interposing member covering the inner corner portion.

The inner core portion in the above-described mode is covered by the inner interposing member and the inner resin portion of the resin molded portion, and the inner interposing member is fixed to the inner core portion using the inner resin portion. The outer corner interposing portion of the inner interposing member has a function that is similar to that of the columnar portion of the above-described resin molded portion.

That is, in the above-described mode, the inner core portion can be supported by the columnar outer corner interposing portion that is disposed in the outer corner portion of the inner core portion and is fixed using the inner resin portion. Specifically, out of all four outer corner portions of two inner core portions that are arranged side by side, two corner portions located at diagonal positions and two corner portions located at opposite positions are supported by the above-described columnar outer interposing portion, and this state is maintained by the inner resin portions. In such a mode described above, strength is improved. Also, in the above-described mode, the inner core portions can be mechanically protected due to the inner interposing portions being provided, and the corner portions of the inner core portions are unlikely to be chipped, and thus strength is improved. If the inner interposing portion is made of an insulating resin, in the above-described mode, insulating properties between the coil and the inner core portions can also be improved due to the inner interposing portions being provided.

An example of the above-described reactor is a mode in which the inner core portion includes at least one of a core piece constituted by a powder compact and a core piece constituted by a compact made of a composite material including magnetic powder and resin.

In the above-described mode, high inductance can be realized while being able to reduce the size, loss is low, and if a core piece constituted by a powder compact is included, higher inductance can be realized and the size can be easily reduced. When a core piece constituted by a composite material is included, if a higher frequency is used, AC loss is low and low loss can be more easily achieved.

Advantageous Effects of Disclosure

The above-described reactor according to this disclosure can have high inductance while being small, and have low loss.

DETAILED DESCRIPTION OF PREFERRED EMBODIMENTS

Figure 1:
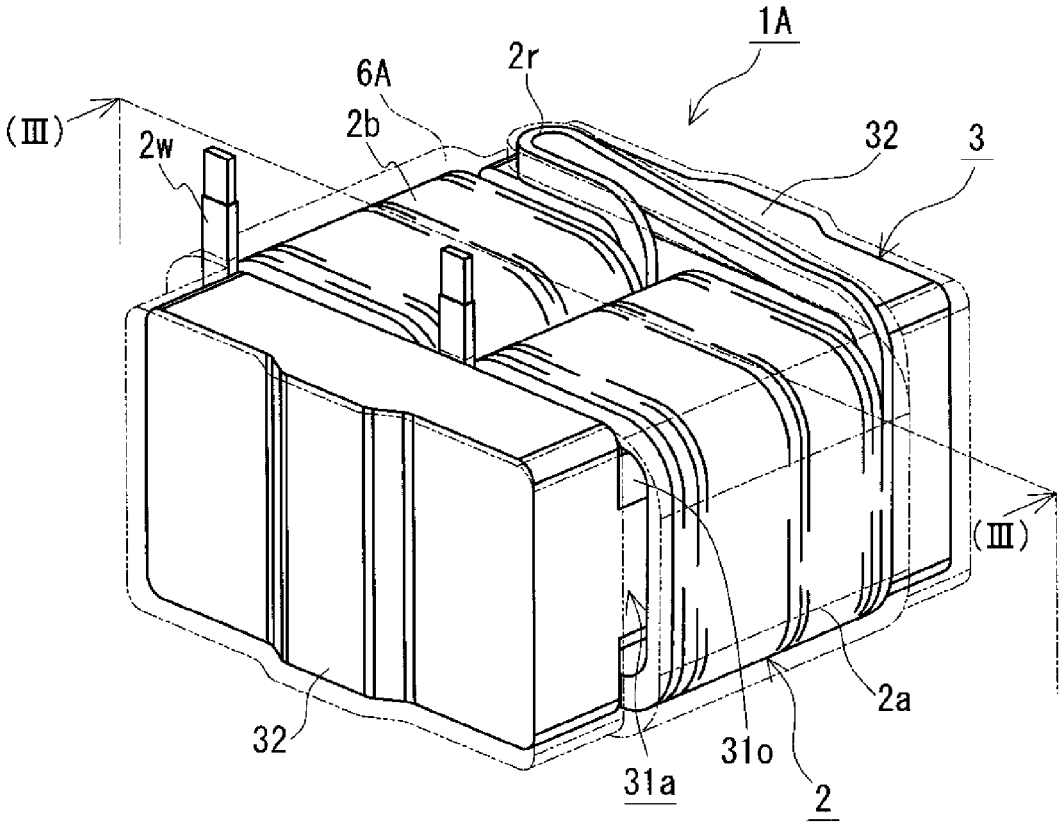
FIG. 1 is a schematic perspective view showing a reactor according to Embodiment 1.

Hereinafter, a reactor according to embodiments of the present disclosure will be specifically described with reference to the drawings. The same reference numerals in the drawings indicate an object having the same name.

Embodiment 1

A reactor 1A of Embodiment 1 will be described mainly with reference to FIGS. 1 to 3. Hereinafter, when the reactor 1A shown in FIG. 1 is attached to an installation target (not shown) such as a converter case, a lower surface in FIG. 1 is regarded as a surface that opposes the installation target (an installation surface that comes into contact with the installation target in some cases). This installation state is merely an example, and another surface may serve as a surface that opposes the installation target.

Reactor

Overall Configuration

As shown in FIG. 1, the reactor 1A of Embodiment 1 includes a coil 2 provided with two winding portions 2*a* and 2*b* obtained by helically winding a winding wire 2*w*, and a magnetic core 3 that is disposed inside and outside the winding portions 2*a* and 2*b*. The magnetic core 3 includes rectangular parallelepiped inner core portions 31*a* and 31*b* disposed inside the winding portions 2*a* and 2*b*, and outer core portions 32 and 32 on which the coil 2 is not substantially disposed and that are disposed outside the winding portions 2*a* and 2*b* and are for linking the inner core portions 31*a* and 31*b* (also see FIG. 2). In the reactor 1A of Embodiment 1, a specific corner portion out of the corner portions of the inner core portions 31*a* and 31*b* is largely chamfered.

Figure 3:
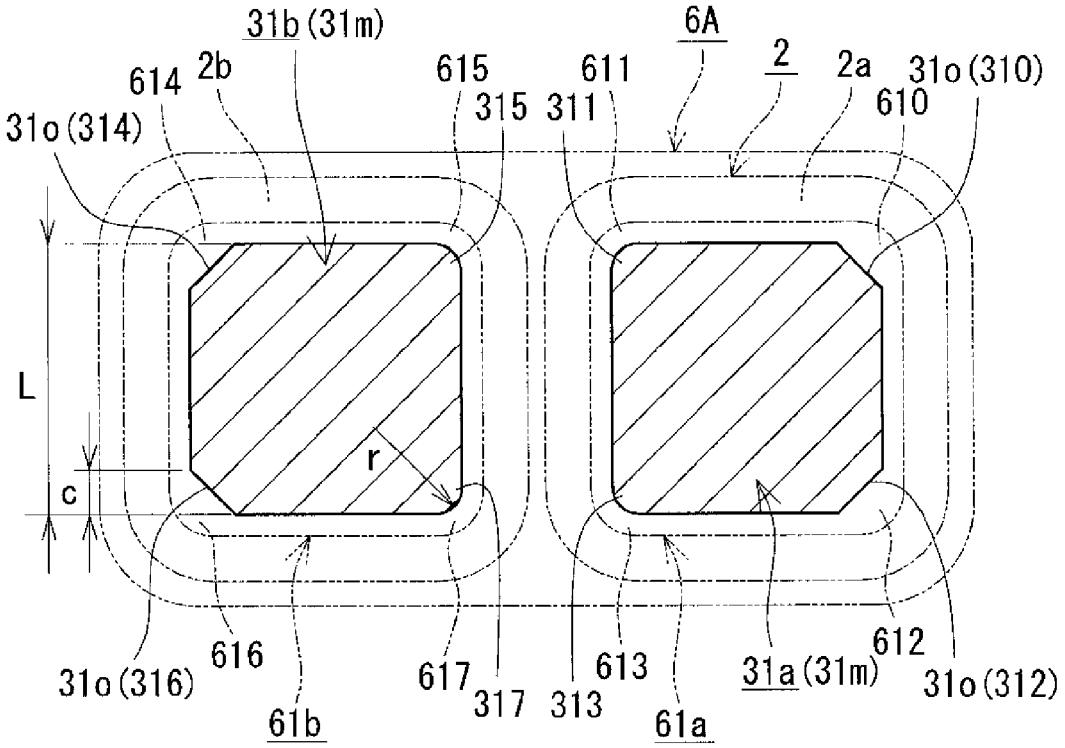
FIG. 3 is a cross-sectional view of a magnetic core included in the reactor according to Embodiment 1, the magnetic core being cut along a plane orthogonal to the axial direction of a coil.

FIG. 3 is a cross-sectional view of the magnetic core 3, the cross sectional view being obtained by cutting the magnetic core 3 along a cutting line (III)-(III) (a plane orthogonal to the axial direction of the winding portions 2*a* and 2*b*) shown in FIG. 1, FIG. 3 showing the inner core portions 31*a* and 31*b*. As shown in FIG. 3, the inner core portions 31*a* and 31*b* each include four corner portions (reference numerals 310 to 313 in the inner core portion 31*a*) and (reference numerals 314 to 317 in the inner core portion 31*b*) facing inner circumferential surfaces of the winding portions 2*a* and 2*b*. At least one of the two outer corner portions (reference numerals 310 and 312 in the inner core portion 31*a*) and (reference numerals 314 and 316 in the inner core portion 31*b*) out of the corner portions 310 to 317 includes a corner chamfering portion 310 that has been chamfered more than the inner corner portions (reference numerals 311 and 313 in the inner core portion 31*a*) and (reference numerals 315 and 317 in the inner core portion 31*b*) that are opposite the outer corner portions (reference numerals 310, 312) and (reference numerals 314, 316), the two outer corner portions being disposed on the side of one winding portion 2*a* (or 2*b*) that is distant from the other winding portion 2*b* (or 2*a*). This example shows a case where all four outer corner portions 310, 312, 314, and 316 (sometimes collectively referred to as an "outer corner group 310 and the like" hereinafter) include the corner chamfering portions 31*o*, and the four outer corner portions are chamfered more than the four inner corner portions 311, 313, 315, and 317 (sometimes collectively referred to as an "inner corner group 311 and the like" hereinafter).

Hereinafter, details thereof will be described.

Coil

As shown in FIG. 1, the coil 2 in this example includes a pair of tubular winding portions 2*a* and 2*b* formed by helically winding one continuous winding wire 2*w*, and a linking portion 2*r* that is constituted by a portion of the winding wire 2*w* and is for connecting the two winding portions 2*a* and 2*b*. The winding portions 2*a* and 2*b* are arranged side by side such that the axes thereof are parallel to each other. The winding wire 2*w* in this example is a coated flat wire, a so-called enameled wire, and the winding wire 2*w* includes a conductor made from a flat wire made of copper or the like, and an insulating coating made of polyamide imide or the like covering the outer circumferential surface of the conductor. Both of the winding portions 2*a* and 2*b* in this example are square tubular edgewise coils with round corner portions, and have the same shape, winding direction, and number of turns. A known coil provided with two winding portions 2*a* and 2*b* arranged side by side can be used as the coil 2. For example, a coil in which the winding portions 2*a* and 2*b* are constituted by different winding wires and are joined through welding can be used. The shape and the number of turns can also be changed as appropriate.

Both of the two end portions of the winding wire 2*w* are drawn out from the winding portions 2*a* and 2*b* in appropriate directions, and terminal metal fittings (not shown) are attached thereto as appropriate, and are electrically connected to an external apparatus (not shown) such as a power source.

Magnetic Core

Overall Configuration

As described above, the magnetic core 3 includes the inner core portions 31*a* and 31*b*, and the outer core portions 32 and 32. As shown in FIG. 2, in the magnetic core 3 in this example, a plurality of core pieces 31*m* and 32*m* are attached to each other in an annular shape, and gap materials 31*g* are interposed between adjacent core pieces. Specifically, the magnetic core 3 includes a plurality of core pieces 31*m* that mainly form the inner core portions 31*a* and 31*b*, a pair of U-shaped core pieces 32*m* and 32*m* constituting the outer core portions 32 and 32 and portions of the inner core portions 31*a* and 31*b*, and a plurality of flat plate-shaped gap materials 31*g*. The magnetic core 3 obtained by attaching these elements to each other in an annular shape forms a closed magnetic circuit when the coil 2 is excited.

The core pieces 31*m* in this example have the same shape, and are rectangular parallelepiped members with a relatively short length in the axial direction of the winding portions 2*a* and 2*b*.

The U-shaped core pieces 32*m* in this example have the same shape, and each include a base portion 320 constituting the outer core portion 32, and protruding portions 321 and 321 protruding from an inner end surface 32*e* of the base portion 320 that is disposed facing end surfaces of the winding portions 2*a* and 2*b*, toward the winding portions 2*a* and 2*b*. The protruding portions 321 and 321 have a shape that is substantially similar to that of the core pieces 31*m*, and are disposed inside the winding portions 2*a* and 2*b* to form portions of the inner core portions 31*a* and 31*b*. The plurality of core pieces 31*m* are disposed in a stacked state between the protruding portions 321 and 321 of the core pieces 32*m* and 32*m* that are disposed facing each other. A member obtained by stacking these plurality of core pieces 31*m* and the protruding portions 321 and 321 constitutes rectangular parallelepiped inner core portions 31*a* and 31*b*.

Shape of Inner Core Portion

The inner core portions 31*a* and 31*b* in this example have the same shape, are housed in the square tubular winding portions 2*a* and 2*b*, and are disposed in line symmetry with respect to the center line of the winding portions 2*a* and 2*b* arranged side by side as shown in FIG. 3.

Out of the four corner portions 310 to 313 of one inner core portion 31*a* facing the inner circumferential surface of the winding portion 2*a*, the outer corner portion 310 located on the upper-right side in FIG. 3 is chamfered more than the opposite inner corner portion 311, and is provided with the corner chamfering portion 31*o*. Similarly, the outer corner portion 312 located on the lower-right side in FIG. 3 is chamfered more than the opposite inner corner portion 313, and is provided with the corner chamfering portion 31*o*.

The same applies to the four corner portions 314 to 317 of the other inner core portion 31*b* facing the inner circumferential surface of the winding portion 2*b*, and the outer corner portion 314 located on the upper-left side in FIG. 3 is chamfered more than the opposite inner corner portion 315, and is provided with the corner chamfering portion 31*o*. The outer corner portion 316 located on the lower-left side in FIG. 3 is chamfered more than the opposite inner corner portion 317, and is provided with the corner chamfering portion 31*o*.

In this example, all of the outer corner group 310 and the like provided in the two inner core portions 31*a* and 31*b* include the corner chamfering portions 31*o*. That is, the reactor 1A in this example includes four corner chamfering portions 310 in total. All of the outer corner group 310 and the like are largely chamfered over the full length of the inner core portions 31*a* and 31*b*, and thus these corner portions are unlikely to be chipped when the coil 2 and the magnetic core 3 are assembled and when a resin molded portion 6A, which will be described later, is formed, for example, and the reactor 1A has good strength.

A configuration can be adopted in which, in the outer corner group 310 and the like, out of the four groups, namely, a group of corner portions located at diagonal positions: (reference numerals 310, 316) and (reference numerals 312, 314) and a group of corner portions located at opposite positions: (reference numerals 310, 314) and (reference numerals 312, 316), at least one group includes the corner chamfering portions 31*o*, and a configuration can also be adopted in which three corner portions (reference numerals 310, 312, 314) or (reference numerals 312, 314, 316) selected from the outer corner group 310 and the like include the corner chamfering portions 31*o*. The higher the number of corner chamfering portions 310 is, the less likely the outer corner group 310 and the like are to be chipped, and strength is further improved.

All of the corner chamfering portions 310 in this example are C-chamfered, showing a case where chamfer widths c of C-chamfering are equal to each other. The chamfering amount (the chamfer width c herein) of the corner chamfering portions 310 is selected in a range in which a decrease in inductance resulting from a decrease in the magnetic path area, an increase in copper loss resulting from an increase in leakage flux and the like can be reduced. Assuming, with regard to one inner core portion 31*a* (or 31*b*), the minimum rectangle (a square in some cases) including a cross section cut along a plane orthogonal to the axial direction of the winding portion 2*a* (or 2*b*), the chamfer width c is about 0.1% to 20% inclusive of a length L of a long side out of long sides and short sides forming the corner portions of this imaginary rectangle, or about 0.5% to 10% inclusive of the length L, for example. Alternatively, examples of the chamfer width c are about 0.1 mm to 10 mm inclusive, and about 0.3 mm to 6 mm inclusive. If C-chamfering is performed as in this example, the outer corner group 310 and the like are less likely to be chipped, and strength is improved, and if the resin molded portion 6A, which will be described later, is included, portions covering the corner chamfering portions 310 (outer corner coating portions 610, 612, 614, and 616) can be made thick, and strength is further improved (details will be described later).

The corner chamfering portion 310 can also be R-chamfered, instead of being C-chamfered. Examples of a rounding radius r of R-chamfering of the corner chamfering portion 310 include about 0.1% to 20% inclusive of the length L of the above-described long side, and about 0.5% to 10% inclusive thereof. Alternatively, examples of the rounding radius r of the corner chamfering portion 310 are about 0.1 mm to 10 mm inclusive, and about 0.3 mm to 6 mm inclusive.

In this example, a case where the inner corner group 311 and the like are also R-chamfered is described (see the inner corner portions 311, 313, 315, and 317 in FIG. 3). Note that the rounding radius r of R-chamfering of the inner corner group 311 and the like is smaller than the chamfer width c of C-chamfering of the corner chamfering portion 31*o*. The chamfer width c and the rounding radius r shown in FIG. 3 are examples.

As described above, the magnetic core 3 includes a plurality (two to four) of corner chamfering portions 31*o*. With regard to all of the corner chamfering portions 31*o*, the chamfering shape (C-chamfering, R-chamfering), and the chamfering amounts (the chamfer width c, the rounding radius r) may be the same as in this example, or the magnetic core 3 can also include corner chamfering portions 310 with different chamfering shapes and different chamfering amounts.

Figure 2:
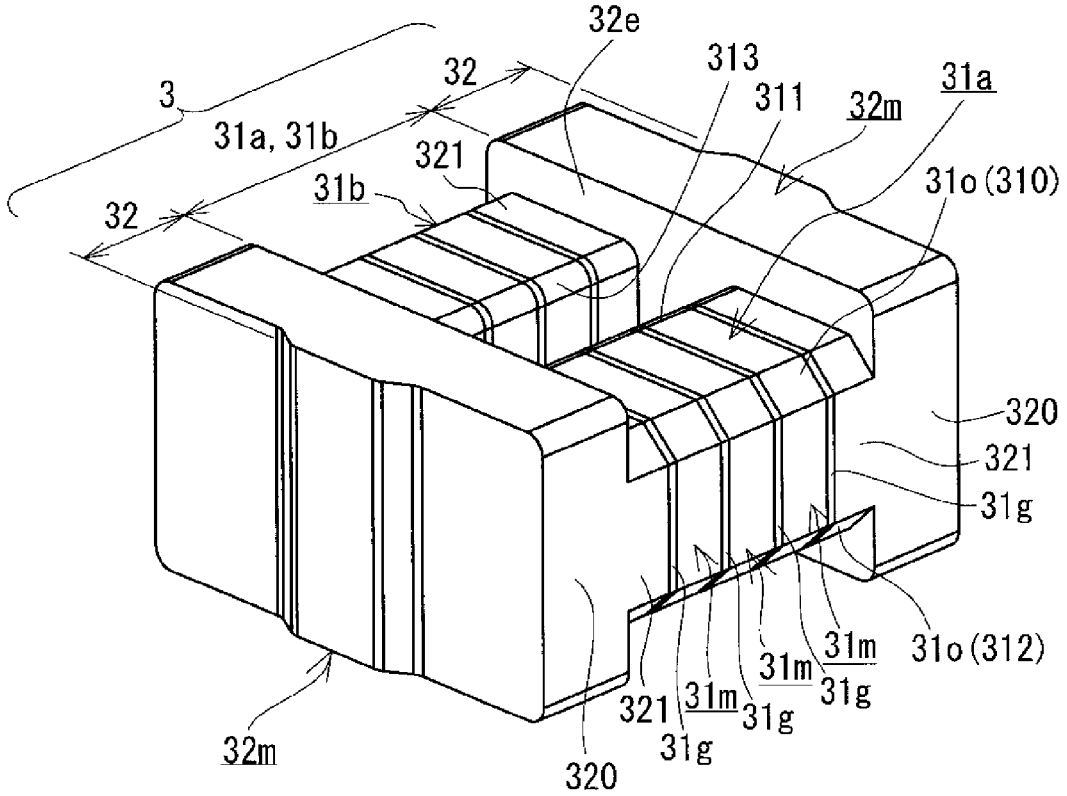
FIG. 2 is a schematic perspective view showing a magnetic core included in the reactor according to Embodiment 1.

In addition, the outer core portions 32 protrude from the inner core portions 31*a* and 31*b* on both a side of that is to face the installation target (the lower side in FIG. 2) and the opposite side (the upper side in FIG. 2). Specifically, the base portion 320 of the U-shaped core piece 32*m* has a portion extending from the protruding portion 321 toward the side that is to face the installation target and a portion extending from the protruding portion 321 toward the opposite side. Because such portions extending in the vertical direction are included, the size of the base portion 320 along the axial direction of the winding portions 2*a* and 2*b* can be reduced, and thus the magnetic core 3 can be made smaller in this respect. If a surface of the base portion 320 that is to face the installation target is flush with surfaces of the winding portions 2*a* and 2*b* that are to face the installation target, heat dissipation into the installation target can be improved, and the stability of an installation state can be improved, for example. Also, the base portion 320 in this example includes a portion protruding from the center of a surface that is opposite the inner end surface 32*e*, in a direction away from the winding portions 2*a* and 2*b*. If the U-shaped core piece 32*m* is constituted by a powder compact, which will be described later, moldability is improved due to such protruding portions being provided. The shape of the outer core portion 32 and the shape of the core piece 32*m* are examples, and can be changed as appropriate. For example, at least one of the above-described extending portion located on the lower side and the above-described extending portion located on the upper side can be omitted. Alternatively, the base portion 320 and the protruding portions 321 can be independent core pieces, for example.

Material

Both of the core pieces 31*m* and 32*m* in this example are powder compacts. Typically, examples of the powder compact include powder compacts obtained by compression molding raw material powder containing magnetic powder and a binder and a lubricant as appropriate into a predetermined shape, and further performing heat treatment after molding. Typically, examples of magnetic powder constituting a powder compact include metal powder constituted by a soft magnetic metal such as pure iron or an iron-based alloy (an Fe—Si alloy, an Fe—Ni alloy, or the like), and coated powder including an insulating coating made of phosphate on outer circumferential surfaces of soft magnetic metal particles. Resin or the like can be used as a binder, and the content thereof is about 30 vol % or less, 20 vol % or less, and about 10 vol % or less. If heat treatment is performed, warp caused by molding can be removed, and loss such as hysteresis loss can be reduced, and a magnetic core 3 with low loss can be obtained. Also, heat treatment can eliminate a binder, and cause thermal denaturation to form an insulating material between powder particles. If an insulating material is provided between powder particles due to the above-described insulating coating being provided, eddy current loss can be reduced, and a magnetic core 3 with low loss can be obtained. A known method such as press molding and a known apparatus can be used in molding.

The content of magnetic powder in a powder compact can be higher than in a compact made of a composite material, which will be described later, and the powder compact tends to have high inductance. Thus, the magnetic core 3 including the core pieces 31*m* and 32*m* constituted by the powder compacts can be made smaller more easily in a case where inductance is kept constant. The reactor 1A including such a magnetic core 3 is reduced in size.

Alternatively, the core pieces 31*m* and 32*m* can be compacts made of a composite material containing magnetic powder and resin. Typically, an example of a compact made of a composite material is a compact obtained by injection molding or cast molding a raw material in a fluid state that contains resin and magnetic powder (may include the above-described insulating coating) made of the above-described soft magnetic metal or a non-metallic soft magnetic material such as ferrite.

The content of magnetic powder in the composite material is 30 vol % to 80 vol % inclusive, and 50 vol % to 75 vol % inclusive, for example. Examples of the content of resin in the composite material is 10 vol % to 70 vol % inclusive, and 20 vol % to 50 vol % inclusive. A compact made of a composite material contains a larger amount of resin than the above-described powder compact, and thus eddy current loss occurring in magnetic powder (in particular, metal powder) can be easily reduced. Thus, the magnetic core 3 including the core pieces 31*m* and 32*m* constituted by compacts made of a composite material can reduce loss such as eddy current loss even if a higher frequency is used, and a magnetic core 3 with low loss can be obtained. Insulating properties between the coil 2 and the magnetic core 3 are improved due to a large amount of resin being included.

Examples of resin in a composite material include thermosetting resins, thermoplastic resins, room temperature curable resins, and low-temperature curable resins. Examples of the thermoplastic resin include polyphenylene sulfide (PPS) resins, polytetrafluoroethylene (PTFE) resins, liquid crystal polymers (LCPs), polyamide (PA) resins (e.g., nylon 6 and nylon 66), polybutylene terephthalate (PBT) resins, and acrylonitrile • butadiene • styrene (ABS) resins. Examples of the thermosetting resin include unsaturated polyester resins, epoxy resins, urethane resins, and silicone resins. In addition, a BMC (Bulk molding compound) obtained by mixing calcium carbonate and glass fiber to unsaturated polyester, millable silicone rubber, millable urethane rubber, and the like can be used.

If a composite material contains nonmagnetic and non-metallic powder, such as alumina or silica, as well as magnetic powder and resin, an improvement in heat dissipation properties can be expected. Examples of the content of nonmagnetic and non-metallic powder is 0.2 mass % to 20 mass % inclusive, and 0.5 mass % to 10 mass % inclusive.

In addition, the magnetic core 3 may include both a core piece constituted by a powder compact and a core piece constituted by a compact made of a composite material.

Gap

The gap members 31*g* are made of a material having a relative magnetic permeability lower than that of the core pieces 31*m* and 32*m*, and typically, are made of a non-magnetic material such as alumina, a dispersion material in which a small amount of magnetic powder is dispersed in resin, or the like. The number of core pieces 31*m* and gap members 31*g*, and the shape and arrangement positions of the gap members 31*g* can be selected as appropriate. An air gap can be used instead of the gap members 31*g*, or in combination with the gap members 31*g*, or a gapless structure in which the gap materials 31*g* are omitted may also be adopted. In this example, because the gap materials 31*g* are disposed in the winding portions 2*a* and 2*b*, loss resulting from flux leaking to the outside of the coil 2 does not substantially occur, and thus a reactor 1A with low loss can be obtained in this respect. If the core pieces 31*m* and 32*m* and the gap materials 31*g* are joined using an adhesive, for example, the magnetic core 3 can be easily kept in an annular shape.

Resin Molded Portion

The reactor 1A of Embodiment 1 further includes a resin molded portion 6A (indicated by virtual lines (line-double dot lines) in FIGS. 1 and 3) for integrally holding the inner core portions 31*a* and 31*b* and the outer core portions 32 and 32. As a result of the resin molded portion 6A integrally holding these portions, the rigidity of the magnetic core 3 serving as an annular integrated object can be increased, and the magnetic core 3 has good strength. If the resin molded portion 6A is made of an insulating resin and is interposed between the coil 2 and the magnetic core 3, the insulating properties thereof are improved. In addition, the resin molded portion 6A can also protect the magnetic core 3 (in particular, the outer core portion 32) from the external environment. The resin molded portion 6A can cover a portion of the magnetic core 3 and allow the other portion to be exposed as long as the resin molded portion 6A can hold the magnetic core 3 integrally. For example, a configuration may be adopted in which a region of the outer core portions 32 that is to face the installation target is not covered by the resin molded portion 6A and is exposed. With this configuration, if the installation target has a cooling structure, a reactor 1A with good heat dissipation properties can be obtained by bringing the above-described exposed region of the outer core portions 32 into the vicinity of the installation target.

As shown in FIG. 3, the resin molded portion 6A may include inner resin portions 61*a* and 61*b* that fill spaces between the winding portions 2*a* and 2*b* and the inner core portions 31*a* and 31*b* and cover at least portions of the outer circumferential surfaces of the inner core portions 31*a* and 31*b*. FIG. 3 shows a case where the inner resin portions 61*a* and 61*b* respectively cover the entire circumferential surfaces of the inner core portions 31*a* and 31*b*. The inner resin portion 61*a* is interposed in a square tubular space provided between one winding portion 2*a* and one inner core portion 31*a*. The inner resin portion 61*b* is interposed in a square tubular space provided between the other winding portion 2*b* and the other inner core portion 31*b*. A reactor 1A including these inner resin portions 61*a* and 61*b* has good insulating properties between the winding portions 2*a* and 2*b* and the inner core portions 31*a* and 31*b*.

Also, portions of the above-described square tubular spaces sandwiched between the outer corner portions of the winding portions 2*a* and 2*b* and the corner chamfering portions 310 are larger than portions sandwiched between the inner corner portions of the winding portions 2*a* and 2*b* and the inner corner group 311 and the like. Thus, portions of the inner resin portions 61*a* and 61*b* with which spaces between the outer corner portions of the winding portions 2*a* and 2*b* and the corner chamfering portions 310 are filled form thick columnar portions. The maximum thickness of these columnar portions, that is, the outer corner coating portions 610, 612, 614, and 616 of the inner resin portions 61*a* and 61*b* covering the corner chamfering portions 310 is larger than the maximum thickness of the inner corner coating portions 611, 613, 615, and 617 covering the inner corner group 311 and the like. In the reactor 1A in this example, the four outer corner portions 310, 312, 314, and 316 of the inner core portions 31*a* and 31*b* are supported by the columnar portions (the outer corner coating portions 610, 612, 614, and 616) of the inner resin portions 61*a* and 61*b*. Such a magnetic core 3 has higher rigidity as an integrated object, and improved strength.

The resin molded portion 6A may have a configuration for covering only the magnetic core 3, or a configuration for further integrally covering the outer circumferential surface of the coil 2, in addition to the magnetic core 3. With the latter configuration, the coil 2 and the magnetic core 3 are held integrally by the resin molded portion 6A, and rigidity of the reactor 1A as an integrated object can be increased. Such a reactor 1A exhibits effects of having good strength, being unlikely to vibrate and ease of noise reduction, and being capable of protecting the coil 2 from the external environment, for example. A configuration may also be adopted in which at least a portion of the outer circumferential surface of the coil 2, for example, a region that is to face the installation target is exposed without being covered by the resin molded portion 6A. With this configuration, if the installation target has a cooling structure, a reactor 1A with good heat dissipation properties can be obtained by bringing the above-described exposed region of the coil 2 into the vicinity of the installation target.

Examples of a material constituting the resin molded portion 6A include insulating resins such as thermoplastic resins and thermosetting resins described in Section Composite Material. If an insulating resin contains the above-described nonmagnetic and non-metallic powder, heat dissipation properties, insulating properties, and the like can be improved. The resin molded portion 6A is obtained by placing an assembly of the coil 2 and the magnetic core 3 shown in FIG. 1 in a mold and positioning it, and performing molding using various molding methods such as injection molding, for example. A thermoplastic resin can be suitably utilized in injection molding. It is thought that, if a region near the outer side including the end surfaces of the winding portions 2*a* and 2*b* and the outer corner group 310 and the like in the square tubular spaces provided between the winding portions 2*a* and 2*b* and the inner core portions 31*a* and 31*b* is used as a portion into which a flowable resin, which is a raw material, is introduced, the resin can be easily introduced into this region.

Applications

The reactor 1A of Embodiment 1 can be used for in-vehicle converters (typically, DC-DC converters) installed in vehicles such as hybrid automobiles, plug-in hybrid automobiles, electric automobiles, and fuel cell automobiles, various converters such as converters of air conditioners, and constituent components of power conversion devices, for example.

Functional Effects

The reactor 1A of Embodiment 1 includes the corner chamfering portions 310 in the outer corner group 310 and the like out of the corner portions 310 to 317 facing the inner circumferential surfaces of the winding portions 2*a* and 2*b* in the inner core portions 31*a* and 31*b*. Although the magnetic path area of the inner core portions 31*a* and 31*b* is reduced because the reactor 1A is provided with the corner chamfering portions 31*o*, the reactor 1A can have high inductance without increasing the size, compared to a conventional configuration in which all of the above-described corner portions are evenly round. That is, the reactor 1A is reduced in size in a case where inductance is kept constant. Also, the reactor 1A has low loss because an increase in loss (in particular, copper loss resulting from an increase in leakage flux) resulting from a decrease in the magnetic path area is also small. These effects will be specifically described using Test Example 1, which will be described later.

Also, the reactor 1A of Embodiment 1 includes the corner chamfering portions 31*o*, and thus as described above, the outer corner group 310 and the like are unlikely to be chipped, and the reactor 1A has good strength.

If the reactor 1A of Embodiment 1 includes the resin molded portion 6A that includes the inner resin portions 61*a* and 61*b* and integrally holds the magnetic core 3, the inner resin portions 61*a* and 61*b* include thick columnar portions covering the corner chamfering portions 31*o*. From the viewpoint of the magnetic core 3 having high rigidity as an integrated object due to the outer corner group 310 and the like being supported by the four columnar portions, the reactor 1A has good strength. Even if, when the resin molded portion 6A is formed, as described above, the vicinity of the outer corner group 310 and the like is used as a portion into which a flowable resin, which is a raw material, is introduced, and molding pressure is concentrated at the outer corner group 310 and the like, from the viewpoint that the outer corner group 310 and the like are unlikely to be chipped due to the corner chamfering portions 310 being provided, the reactor 1A has good strength.

Embodiment 2

Figure 4:
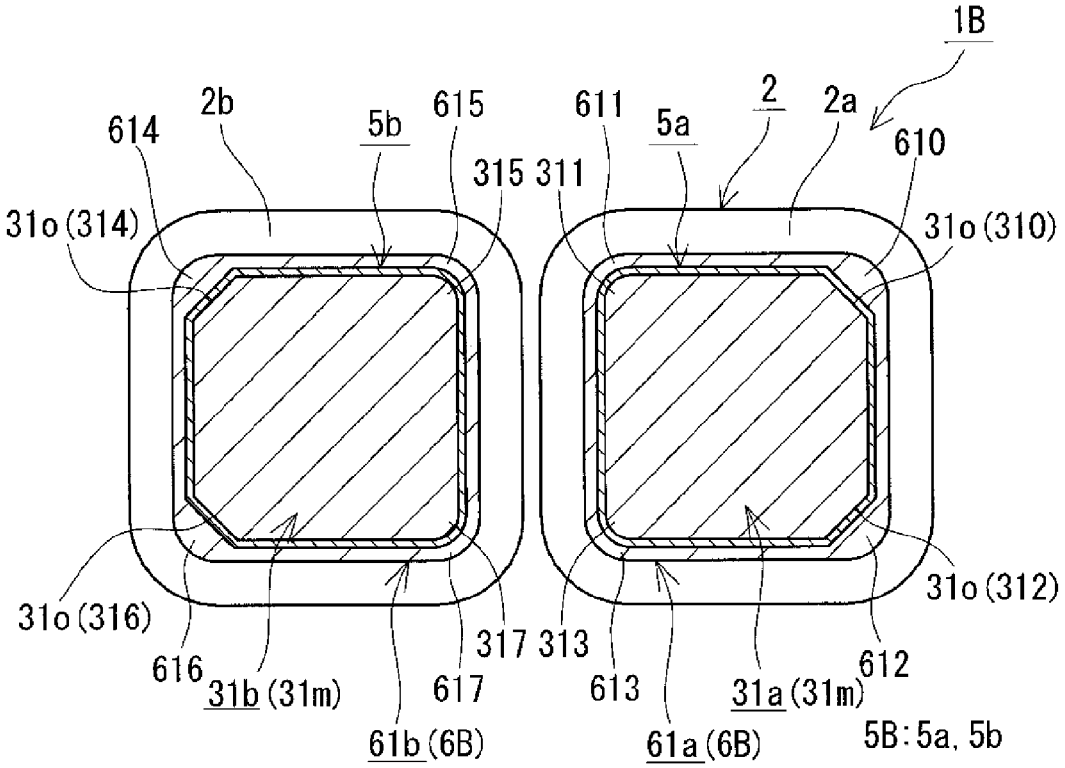
FIG. 4 is a cross-sectional view of a reactor according to Embodiment 2, the reactor being cut along a plane orthogonal to the axial direction of a coil, and shows only winding portions and inner portions thereof.

A reactor 1B of Embodiment 2 will be described with reference to FIG. 4 The basic configuration of the reactor 1B is similar to that of the reactor 1A of Embodiment 1 including the resin molded portion 6A, and the reactor 1B includes a coil 2 provided with winding portions 2*a* and 2*b*, a magnetic core 3 including corner chamfering portions 310 in an outer corner group 310 and the like, and a resin molded portion 6B that includes inner resin portions 61*a* and 61*b* and is for integrally holding inner core portions 31*a* and 31*b* and outer core portions 32 and 32 (FIG. 1). The reactor 1B of Embodiment 2 is different from Embodiment 1 in that the reactor 1B includes an interposing member 5B interposed between the coil 2 and the magnetic core 3. Hereinafter, this difference will be described in detail, and a detailed description of a configuration, effects, and the like other than the difference will be omitted.

The interposing member 5B in this example includes inner interposing members 5*a* and 5*b* that are interposed between the winding portions 2*a* and 2*b* and the inner core portions 31*a* and 31*b* and are attached to the inner core portions 31*a* and 31*b*. The inner interposing members 5*a* and 5*b* are square tubular members extending along the outer shape of the rectangular parallelepiped inner core portions 31*a* and 31*b*. Portions of the inner interposing members 5*a* and 5*b* covering the corner chamfering portions 310 have a shape that is C-chamfered along the corner chamfering portions 31*o*, and are different from the shape of portions covering the inner corner group 311 and the like (the shape that is slightly R-chamfered). Although each of the inner interposing members 5*a* and 5*b* can be an integrally molded tubular member, if each of the inner interposing members 5*a* and 5*b* is an assembly of multiple divided pieces (for example, an assembly of divided pieces that can be divided in the vertical direction in FIG. 4), the inner interposing members 5*a* and 5*b* can be easily attached to the inner core portions 31*a* and 31*b*. Also, if through-holes, grooves (not shown), or the like are provided at appropriate positions of the inner interposing members 5*a* and 5*b* to serve as flow channels through which flowable resin, which is the raw material of the resin molded portion 6B, flows, filling workability is improved, and the area of contact between the inner interposing members 5*a* and 5*b* and the resin molded portion 6B can be increased, and the inner interposing members 5*a* and 5*b* can be firmly integrated with the coil 2 and the magnetic core 3.

In the reactor 1B of Embodiment 2, the inner interposing members 5*a* and 5*b* are attached to the inner core portions 31*a* and 31*b*, and the inner resin portions 61*a* and 61*b* are provided to cover the outer circumferential surfaces of these inner interposing members 5*a* and 5*b*. In this example, portions of the inner interposing members 5*a* and 5*b* covering the corner chamfering portions 310 have a shape extending along the corner chamfering portions 310 as described above, and do not extend along the inner circumferential shape of the winding portions 2*a* and 2*b*. Thus, in square tubular spaces provided between the winding portions 2*a* and 2*b* and the inner interposing members 5*a* and 5*b*, portions sandwiched between the outer corner portions of the winding portions 2*a* and 2*b* and portions of the inner interposing members 5*a* and 5*b* covering the corner chamfering portions 310 are larger than the other portions. Portions with which the above-described sandwiched portions of the inner resin portions 61*a* and 61*b* are filled are the above-described thick columnar portions. The maximum thickness of these columnar portions, that is, the outer corner coating portions 610, 612, 614, and 616 of the inner resin portions 61*a* and 61*b* covering the corner chamfering portions 310 is larger than the maximum thickness of the inner corner coating portions 611, 613, 615, and 617 covering the inner corner group 311 and the like. In the reactor 1B in this example, the four outer corner portions 310, 312, 314, and 316 in the inner core portions 31*a* and 31*b* are supported by the columnar portions (the outer corner coating portions 610, 612, 614, and 616) of the inner resin portions 61*a* and 61*b*. That is, all of the corner portions (reference numerals 310, 316) and (reference numerals 312, 314) located at diagonal positions of the inner core portions 31*a* and 31*b* and the corner portions (reference numerals 310, 314) and (reference numerals 312, 316) located at opposite positions thereof are supported by the columnar portions, and mechanical strength is increased. Such a magnetic core 3 has higher rigidity as an integrated object, and improved strength.

Examples of a material constituting the interposing member 5B include insulating resins such as the thermoplastic resins described in Section Resin molded portion 6A. The thickness of the inner interposing members 5*a* and 5*b* can be selected as appropriate with consideration given to the thickness of the inner resin portions 61*a* and 61*b* of the resin molded portion 6B. In this example, as shown in FIG. 4, the inner interposing members 5*a* and 5*b* each have an even thickness over the entire length thereof.

The reactor 1B of Embodiment 2 exhibits effects that are similar to those of the reactor 1A of Embodiment 1. That is, the obtained effects are that high inductance can be realized while being able to reduce the size, loss is low, and strength is increased due to the corner chamfering portions 310 being provided. Furthermore, the reactor 1B of Embodiment 2 exhibits effects of the outer corner group 310 and the like being prevented from being chipped when the resin molded portion 6B is molded, the inner core portions 31*a* and 31*b* are mechanically protected, and the insulating properties between the winding portions 2*a* and 2*b* and the inner core portions 31*a* and 31*b* are improved, due to the interposing member 5B, in particular, the inner interposing members 5*a* and 5*b* being provided. The reactor 1B of Embodiment 2 also exhibits effects of strength being increased due to the columnar portions (the outer corner coating portions 610, 612, 614, and 616) of the resin molded portion 6B being provided.

In addition, the interposing member 5B can include a pair of frame members (not shown) interposed between the end surfaces of the winding portions 2*a* and 2*b* and the inner end surfaces 32*e* of the outer core portions 32 (the core pieces 32*m*). In this case, the insulating properties between the coil 2 and the magnetic core 3 can be further increased. If the frame members and the inner interposing members 5*a* and 5*b* are respectively integrated objects, the number of components can be reduced. If frame members are included, it is preferable to provide, as appropriate, the interposing member 5B with a groove, a through-hole, a notch, or the like serving as a flow channel for introducing flowable resin, which is the raw material of the resin molded portion 6B.

Embodiment 3

Figure 5:
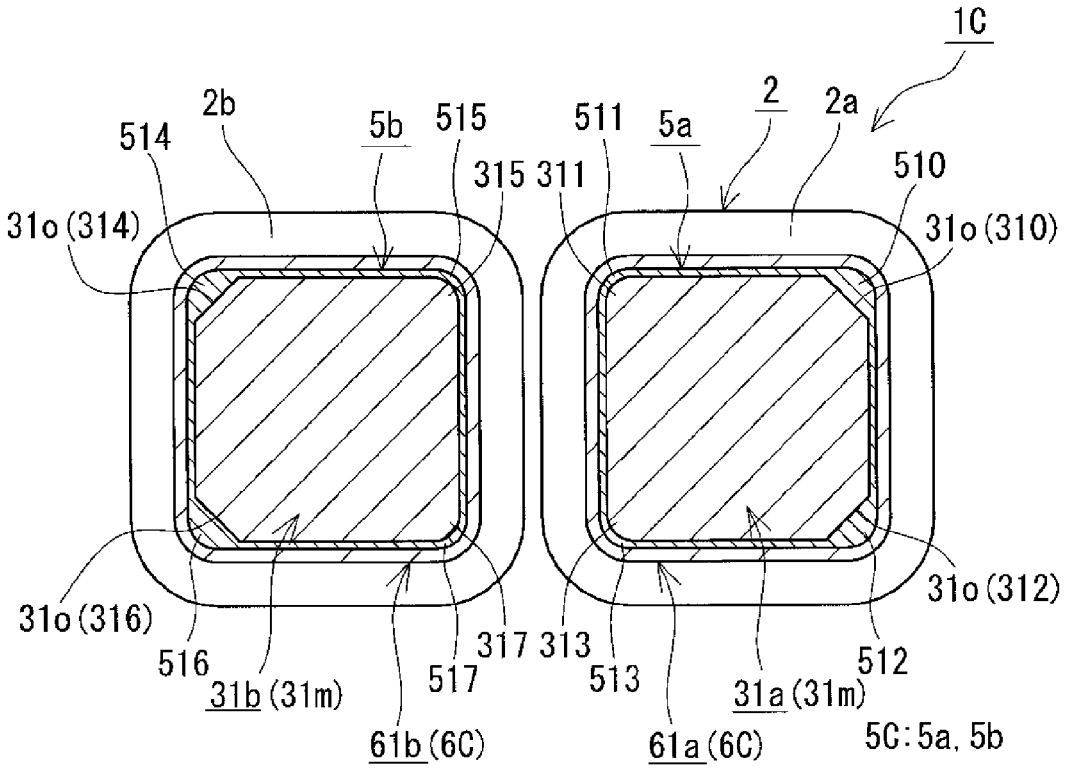
FIG. 5 is a cross-sectional view of a reactor according to Embodiment 3, the reactor being cut along a plane orthogonal to the axial direction of a coil, and shows only winding portions and inner portions thereof.

A reactor 1C of Embodiment 3 will be described with reference to FIG. 5 The basic configuration of the reactor 1C is similar to that of the reactor 1B of Embodiment 2, and the reactor 1C includes a coil 2 provided with winding portions 2*a* and 2*b*, a magnetic core 3 including corner chamfering portions 310 in an outer corner group 310 and the like, a resin molded portion 6C that includes inner resin portions 61*a* and 61*b* and is for integrally holding inner core portions 31*a* and 31*b* and outer core portions 32 and 32 (FIG. 1), and an interposing member 5C interposed between the coil 2 and the magnetic core 3. The interposing member 5C in this example includes inner interposing members 5*a* and 5*b*, and is provided with the inner resin portions 61*a* and 61*b* to cover the outer circumferential surfaces of the inner interposing members 5*a* and 5*b*. The reactor 1C of Embodiment 3 is mainly different from Embodiment 2 in that portions of the inner interposing members 5*a* and 5*b* covering the corner chamfering portions 310 are locally thick. Hereinafter, this difference will be described in detail, and a detailed description of a configuration, effects, and the like other than the difference will be omitted. Details of the interposing member 5C can refer to the interposing member 5B of Embodiment 2, except for the above-described difference.

As described above, portions of the inner interposing members 5*a* and 5*b* covering the corner chamfering portions 310 are locally thick. That is, the maximum thickness of the outer corner interposing portions 510, 512, 514, and 516 of the inner interposing members 5*a* and 5*b* covering the corner chamfering portions 310 is larger than the maximum thickness of the inner corner interposing portions 511, 513, 515, and 517 covering the inner corner group 311 and the like. On the other hand, portions of the inner interposing members 5*a* and 5*b* other than the outer corner interposing portions 510, 512, 514, and 516 substantially extend along the outer shape of the inner core portions 31*a* and 31*b*. Thus, square tubular spaces provided between the winding portions 2*a* and 2*b* and the inner interposing members 5*a* and 5*b* each have an even thickness over the entire length thereof, and the inner resin portions 61*a* and 61*b* with which these spaces are filled also each have a tubular shape with an even thickness over the entire length thereof. In the reactor 1C, the four outer corner portions 310, 312, 314, and 316 in the inner core portions

31*a* and 31*b* are supported by the columnar portions (the outer corner interposing portions 510, 512, 514, and 516) of the inner interposing members 5*a* and 5*b*, and this state is maintained by the inner resin portions 61*a* and 61*b*. That is, all of the corner portions (reference numerals 310, 316) and (reference numerals 312, 314) located at diagonal positions of the inner core portions 31*a* and 31*b* and the corner portions (reference numerals 310, 314) and (reference numerals 312, 316) located at opposite positions thereof are supported by the columnar portions (the outer corner interposing portions 510, 512, 514, and 516), and mechanical strength is increased. Such a magnetic core 3 has higher rigidity as an integrated object, and improved strength.

The reactor 1C of Embodiment 3 exhibits effects that are similar to those of the reactor 1B of Embodiment 2, that is, high inductance can be realized while being able to reduce the size, loss is low, and strength is increased due to the corner chamfering portions 310 being provided, the outer corner group 310 and the like are prevented from being chipped when the resin molded portion 6C is molded, the inner core portions 31*a* and 31*b* are mechanically protected, and the insulating properties between the winding portions 2*a* and 2*b* and the inner core portions 31*a* and 31*b* are improved, due to the interposing member 5C, in particular, the inner interposing members 5*a* and 5*b* being provided. The reactor 1C of Embodiment 3 also exhibits effects of strength being increased due to the columnar portions (the outer corner interposing portions 510, 512, 514, and 516) of the inner interposing members 5*a* and 5*b* being provided. If the interposing member 5C includes the above-described frame members and the inner interposing members 5*a* and 5*b* and these frame members are an integrated molded article, the interposing member 5C has high rigidity. As a result of such an interposing member 5C being fixed to the magnetic core 3 using the resin molded portion 6C, a reactor 1C with improved strength can be obtained.

In addition, a configuration is possible in which, as a result of changing the shape of the inner interposing members 5*a* and 5*b* to be attached to the inner core portions 31*a* and 31*b*, the above-described columnar portions for supporting the inner core portions 31*a* and 31*b* are different from each other. For example, one inner core portion 31*a* includes, as columnar portions to which the inner interposing member 5*a* of Embodiment 2 having an even thickness is attached and that are for supporting the outer corner portions 310 and 312, outer corner coating portions 610 and 612 realized by a resin molded portion. The other inner core portion 31*b* includes, as columnar portions to which the inner interposing member 5*b* of Embodiment 3 having an uneven thickness is attached and that are for supporting the outer corner portions 314 and 316, the outer corner interposing portions 514 and 516 of Embodiment 3.

Test Example 1

With regard to reactors with different chamfering amounts of corner portions of inner core portions, inductance and loss were obtained through simulations.

Figure 6:
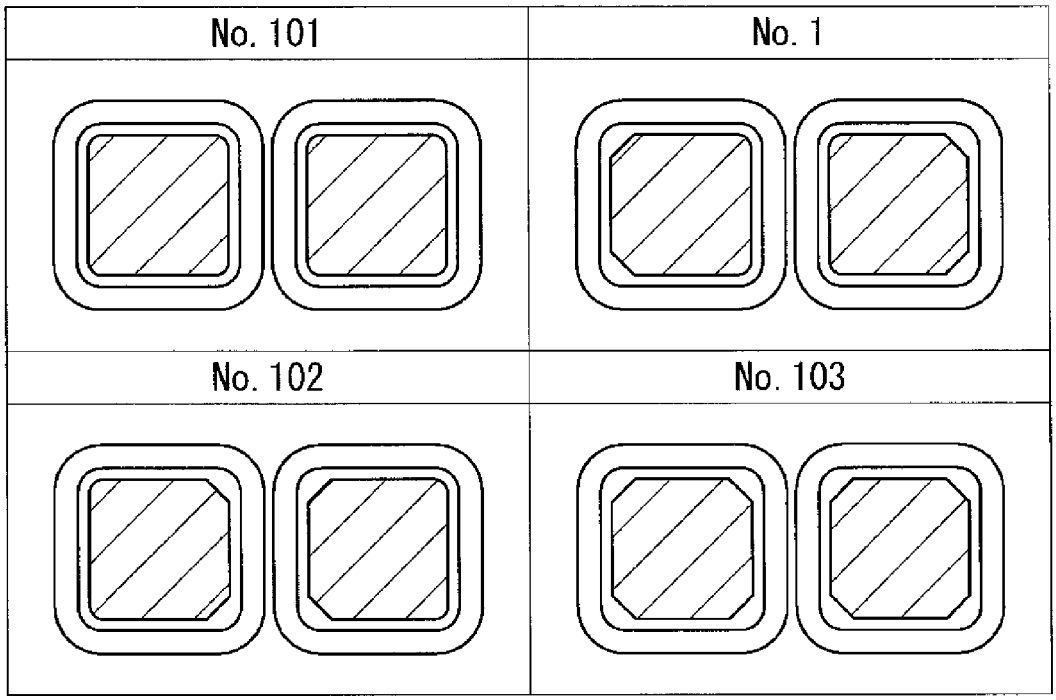
FIG. 6 is a diagram illustrating shapes of inner core portions of samples of Test Example 1.

Herein, reactors as described in Embodiment 1, that is, reactors each included, as the basic configuration, a coil provided with two winding portions arranged side by side, and an annular magnetic core including rectangular parallelepiped inner core portions disposed in the winding portions and outer core portions disposed outside the winding portions, and the reactors had the same specifications, except that states in which the corner portions of the inner core portions were chamfered were different from each other. In all four samples below, the outer shapes of the reactors had the same size. Inner core portions of the samples are shown in FIG. 6. FIG. 6 schematically shows cross sections obtained by cutting the winding portions and the inner core portions along a plane orthogonal to the axial direction of the winding portions (see a cutting line (III)-(III) shown in FIG. 1). As shown in FIG. 6, in the samples, the corner portions of the inner core portions had different sizes depending on the chamfering amounts, but the size of the outer shapes of the winding portions and the size of the minimal rectangles enveloping the above-described cross sections of the inner core portions were the same.

No. 101

Sample No. 101 was a sample in which four corner portions of inner core portions facing inner circumferential surfaces of winding portions were evenly R-chamfered, and corresponded to a conventional configuration. The rounding radius r of R-chamfering was 3 mm.

No. 1

Sample No. 1 was a sample in which, out of four corner portions of each of the inner core portions facing an inner circumferential surface of a winding portion, all of the outer corner portions were C-chamfered, and all of the inner corner portions were R-chamfered. The chamfer width c of C-chamfering was 4.5 mm, the rounding radius r of R-chamfering was 3 mm, and the chamfer width c in the outer corner portions was larger than the rounding radius r in the inner corner portions. Thus, the magnetic path area of the inner core portion of Sample No. 1 was smaller than that of Sample No. 101.

No. 102

Sample No. 102 was a sample in which inner and outer chamfering were reversed with respect to Sample No. 1. That is, all of the outer corner portions were R-chamfered (the rounding radius r=3 mm), and all of the inner corner portions were C-chamfered (the chamfer width c=4.5 mm), and thus the rounding radius r in the outer corner portions was smaller than the chamfer width c in the inner corner portions. The magnetic path area of the inner core portion of Sample No. 102 was smaller than that of Sample No. 101, and was substantially equal to that of Sample No. 1.

No. 103

Sample No. 103 was a sample in which four corner portions were evenly C-chamfered (the chamfer width c=4.5 mm), with respect to Sample No. 101. The magnetic path area of the inner core portion of Sample No. 103 was smaller than that of Sample No. 101 and 102, and Sample No. 1, and the inner core portion of Sample No. 103 had the smallest magnetic path area out of the four samples.

Figure 7:
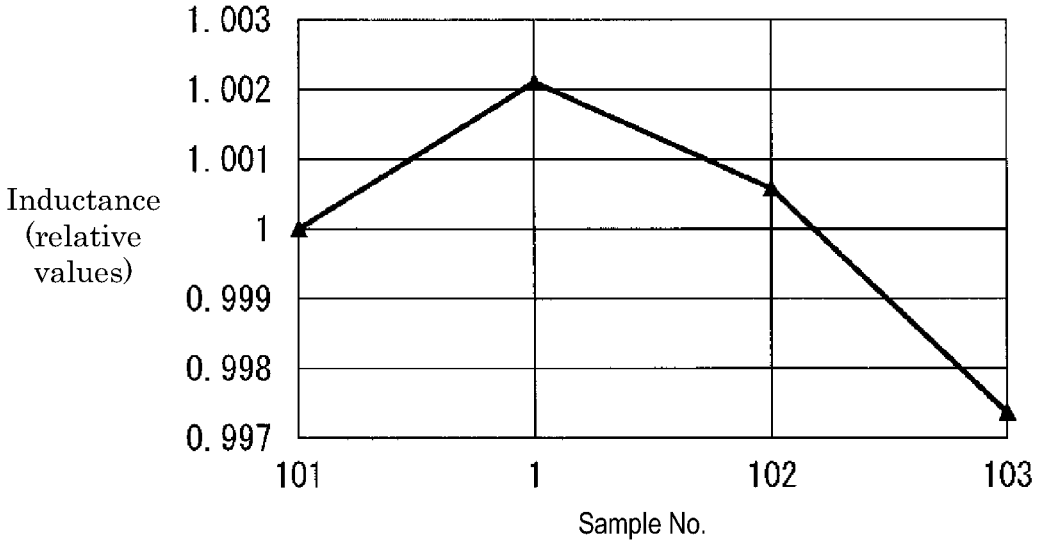
FIG. 7 is a graph showing inductance (relative values) of the samples measured in Test Example 1.

Inductance (μH) occurring when an electric current selected from a range of more than 0 A to 400 A or less flows through the reactors of the samples was obtained through simulations. Examples of the inductance at a predetermined electric current value selected from 200 A to 350 A are shown in Table 1 and FIG. 7. In Table 1 and FIG. 7, inductance of samples other than Sample No. 101 is shown as relative values using the inductance of Sample No. 101 as a reference (inductance of each sample/inductance of Sample No. 101). FIG. 7 is a graph showing inductance of the samples using relative values, and the horizontal axis indicates Sample No., and the vertical axis indicates inductance (relative values). Commercially available software (e.g., JMAG-Designer manufactured by JSOL Corporation) can be used in simulation of measurement of inductance and simulation of total loss, which will be described later.

Figure 8:
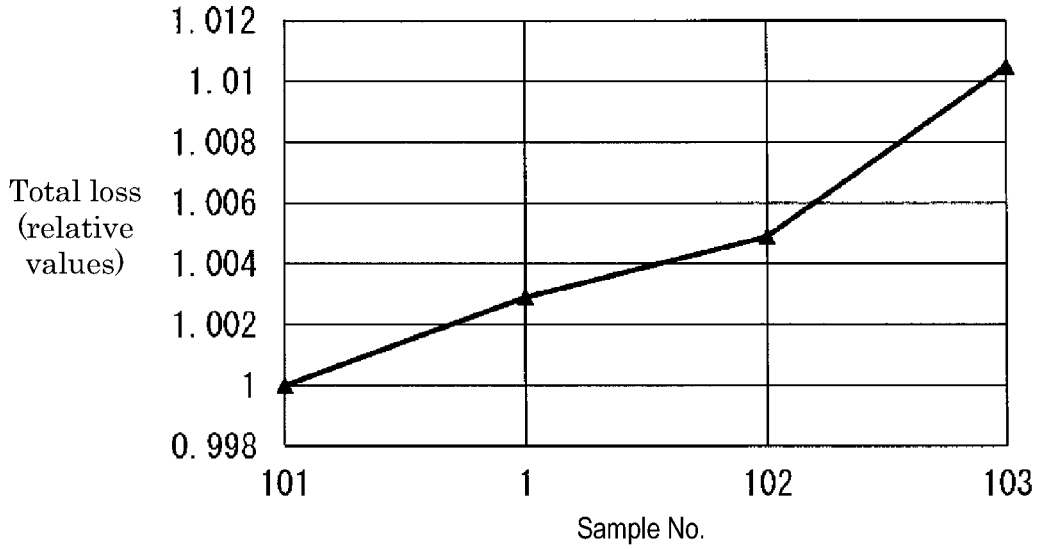
FIG. 8 is a graph showing total loss (relative values) of the samples measured in Test Example 1.

DC copper loss (W), iron loss (W), and AC copper loss (W) that occur when the reactor of each sample is driven at a direct electric current of 50 A, an input voltage of 300 V, an output voltage of 300 V and a frequency of 10 kHz were obtained through simulations, and total loss that is the sum of DC copper loss, iron loss, and AC copper loss is shown in Table 1 and FIG. 8. Table 1 and FIG. 8 show relative values of the total loss of samples other than Sample No. 101 using total loss of Sample No. 101 as a reference (total loss of each sample/total loss of Sample No. 101). FIG. 8 is a graph showing total loss of the samples using relative values, and the horizontal axis indicates Sample No., and the vertical axis indicates total loss (relative values). Also, iron loss of samples other than Sample No. 101 is shown using relative values in Table 1, using iron loss of Sample No. 101 as a reference (iron loss of each sample/iron loss of Sample No. 101.

TABLE 1

| | Sample No. | | | |
|---|---|---|---|---|
| | 101 | 1 | 102 | 103 |
| Inductance (relative values) | 1 | 1.00210 | 1.00058 | 0.99737 |
| Total loss (relative values) | 1 | 1.00291 | 1.00489 | 1.01048 |
| Iron loss (relative values) | 1 | 0.995 | 0.998 | 1.002 |

It is understood that, as shown in Table 1 and FIG. 7, Sample No. 1 in which, out of corner portions of inner core portions facing inner circumferential surfaces of winding portions, only the outer corner portions that were largely chamfered had higher inductance than Sample No. 101 in which inner and outer corner portions were evenly slightly chamfered. Also, Sample No. 1 had a larger increase in inductance, compared to Sample No. 102 in which the inner corner portions were largely chamfered, instead of the outer corner portions. On the other hand, it is understood that Sample No. 103 in which the inner and outer corner portions were evenly largely chamfered had smaller inductance than Sample No. 101. Herein, as shown in Sample No. 103, normally, a decrease in the magnetic path area results in a decrease in inductance. Sample No. 1 had high inductance while the magnetic path area decreased compared to Sample No. 101. It is thought that one of the reasons for this is that magnetic flux was more likely to be concentrated on the inner side of the inner core portions and leakage flux was more likely to be reduced because of the shape resulting from the outer corner portions being chamfered more than the inner corner portions. Note that, although one example is shown in Table 1, it was confirmed that similar trends were observed in a range of 200 A to 350 A.

As shown in Table 1 and FIG. 8, with Sample No. 1 in which, out of the corner portions of the inner core portions facing the inner circumferential surfaces of the winding portions, only the outer corner portions were largely chamfered, loss was increased, compared to Sample No. 101 in which the inner and outer corner portions were evenly slightly chamfered, but an increase in the loss was small. Herein, an increase ratio of loss was about 0.29%. Also, in Sample No. 1, an increase in loss was very small, compared to Sample No. 102 (the increase ratio: about 0.49%) in which the inner corner portions were largely chamfered, instead of the outer corner portions, and Sample No. 103 (the increase ratio: about 1.05%) in which the inner and outer corner portions were evenly largely chamfered. Herein, if the size of the inner core portion is reduced through large chamfering, iron loss can be reduced. However, as shown in Sample No. 103, a decrease in the magnetic path area results in an increase in leakage flux, and an increase in copper loss resulting from this leakage flux. Also, it is thought that magnetic flux is more likely to leak on the inner side of loops of magnetic flux than on the outer side, and thus if the inner corner portions of the inner core portions are chamfered as in Sample No. 102, leakage flux is more likely to occur. It is thought that Samples No. 102 and 103 had a significant increase in copper loss resulting from leakage flux, and thus loss was increased. It is thought that, with Sample No. 1, as a result of chamfering the outer corner portions of the inner core portions, an increase in leakage flux was suppressed, and an increase in copper loss resulting from leakage flux was reduced, and as shown in Table 1, iron loss was reduced, as a result of which the total loss of copper loss and iron loss was reduced.

Through the above-described tests, it was revealed that, in a reactor including a coil provided with two winding portions arranged side by side and a magnetic core including rectangular parallelepiped inner core portions disposed in the winding portions, as a result of chamfering outer corner portions of the inner core portions facing inner circumferential surfaces of the winding portions more than inner corner portions, inductance was increased without increasing the size of the reactor, and loss was low. It was indicated that such a reactor can be made smaller more easily in a case where inductance is kept constant. Also, such a reactor has good strength and the outer corner portions are unlikely to be chipped.

The present disclosure is not limited to these examples, but is indicated by the scope of the claims, and all changes that come within the meaning and range of equivalency of the claims are intended to be embraced therein.

For example, at least one of the following modifications and additions to the reactors 1A to 1C of Embodiments 1 to 3 are possible.

(1) A sensor (not shown), such as a temperature sensor, an electric current sensor, a voltage sensor, and a magnetic flux sensor, which is configured to measure physical quantities of a reactor is included.

(2) If the coil 2 is exposed without being covered by the resin molded portion 6A, for example, the winding portions 2*a* and 2*b* include heat dissipation plates (not shown). According to this configuration, a reactor 1A with good heat dissipation properties can be obtained, for example.

(3) If the coil 2 is exposed without being covered by the resin molded portion 6A, for example, heat sealed resin portions (not shown) for joining adjacent turns constituting the winding portions 2*a* and 2*b* are included. According to this configuration, the resin molded portion 6A for integrally holding the magnetic core 3 can be molded utilizing the winding portions 2*a* and 2*b* as a mold for the inner resin portions 61*a* and 61*b*, for example.

case (e.g., made of metal such as aluminum or an aluminum alloy) for housing an assembly including the coil 2 and the magnetic core 3 is included. According to this configuration, it is possible to obtain a reactor 1A that can protect the assembly from the external environment and has good heat dissipation properties utilizing a metal case as a heat dissipation path of the coil 2, for example.

Also, a heat dissipation layer is included between the assembly and an inner bottom surface of the case. According to this configuration, it is possible to obtain a reactor 1A by which insulating properties between the coil 2 and the metal case can be improved and that has better heat dissipation properties. A specific example of the heat dissipation layer is a material containing a filler with good heat dissipation properties (nonmagnetic and non-metallic powder such as alumina) and resin (may be an adhesive).

Furthermore, a sealing material (that can contain resin such as an epoxy resin or a silicone resin, and the above-described filler) for embedding the assembly in the case is included. According to this configuration, it is possible to obtain a reactor 1A that can protect the assembly from the external environment and has good heat dissipation properties utilizing the sealing material and the metal case as a heat dissipation path of the coil 2, for example.

The invention claimed is:

1. A reactor comprising:

a coil provided with two winding portions that are obtained by winding a winding wire such that axes of the winding portions are parallel to each other;

a magnetic core including a rectangular parallelepiped inner core portion disposed in each of the winding portions, and outer core portions that are disposed outside the winding portions and are for linking the inner core portions; and a resin molded portion for integrally holding the inner core portions and the outer core portions, wherein at least one of two outer corner portions out of four corner portions of each of the inner core portions includes a corner chamfering portion that has been chamfered more than an inner corner portion that is opposite the outer corner portion, the four corner portions facing an inner circumferential surface of the winding portion and the two outer corner portions being disposed on the side of each winding portion that is distant from the other winding portion, the resin molded portion includes an inner resin portion that fills a space between the winding portions and the inner core portions and covers at least a portion of an outer circumferential surface of the inner core portions, and a thickness of an outer corner coating portion of the inner resin portion covering the corner chamfering portion is locally thick, and the maximum thickness of the outer corner coating portion is thicker than the maximum thickness of an inner corner coating portion of the inner resin portion covering the inner corner portion.

2. A reactor comprising:

a coil provided with two winding portions that are obtained by winding a winding wire such that axes of the winding portions are parallel to each other;

a magnetic core including a rectangular parallelepiped inner core portion disposed in each of the winding portions, and outer core portions that are disposed outside the winding portions and are for linking the inner core portions;

a resin molded portion for integrally holding the inner core portions and the outer core portions; and inner interposing members that are respectively interposed between the winding portions and the inner core portions and attached to the inner core portions, wherein at least one of two outer corner portions out of four corner portions of each of the inner core portions includes a corner chamfering portion that has been chamfered more than an inner corner portion that is opposite the outer corner portion, the four corner portions facing an inner circumferential surface of the winding portion and the two outer corner portions being disposed on the side of each winding portion that is distant from the other winding portion, the resin molded portion includes an inner resin portion that fills a space between the winding portions and the inner core portions and covers at least a portion of an outer circumferential surface of the inner core portions, and a thickness of an outer corner interposing portion of the inner interposing member covering the corner chamfering portion is locally thick, and the maximum thickness of the outer corner interposing portion is thicker than the maximum thickness of an inner corner interposing portion of the inner interposing member covering the inner corner portion.

3. The reactor according to claim 1, wherein the inner core portion includes at least one of a core piece constituted by a powder compact and a core piece constituted by a compact made of a composite material including magnetic powder and resin.

4. The reactor according to claim 3, wherein the corner chamfering portion is C-chamfered.

5. The reactor according to claim 2, wherein the inner core portion includes at least one of a core piece constituted by a powder compact and a core piece constituted by a compact made of a composite material including magnetic powder and resin.

6. The reactor according to claim 5, wherein the corner chamfering portion is C-chamfered.

* * * * *